US008770450B2

(12) United States Patent
Giraud et al.

(10) Patent No.: US 8,770,450 B2
(45) Date of Patent: Jul. 8, 2014

(54) CYLINDRICAL SPOUT FOR DISPOSABLE CARTONS

(75) Inventors: Jean-Pierre Giraud, Auburn, AL (US); Herve Pichot, Chenneviere sur Marne (FR)

(73) Assignee: Capitol Plastic Products, LLC, Amsterdam, NY (US)

( * ) Notice: Subject to any disclaimer, the term of this patent is extended or adjusted under 35 U.S.C. 154(b) by 798 days.

(21) Appl. No.: 12/993,395

(22) PCT Filed: Nov. 26, 2008

(86) PCT No.: PCT/US2008/084850

§ 371 (c)(1), (2), (4) Date: Nov. 18, 2010

(87) PCT Pub. No.: WO2009/070669

PCT Pub. Date: Jun. 4, 2009

(65) Prior Publication Data

US 2011/0095059 A1 Apr. 28, 2011

Related U.S. Application Data

(60) Provisional application No. 61/017,224, filed on Dec. 28, 2007, provisional application No. 60/990,800, filed on Nov. 28, 2007, provisional application No. 60/990,825, filed on Nov. 28, 2007.

(51) Int. Cl.
*B65D 47/10* (2006.01)

(52) U.S. Cl.
USPC ..... 222/541.9; 222/541.2; 222/541.4; 222/541.6; 220/269; 220/270; 220/278

(58) Field of Classification Search
USPC ..... 222/541.1–541.9, 556, 526, 572, 206, 222/214, 215, 153.06, 153, 153.7, 557, 81; 383/80, 906; 215/386, 11.5, 11.6; 229/123.2, 123.3, 125.04, 125.15; 220/266, 258.2, 258.1, 258.3, 267, 220/269, 270, 278
See application file for complete search history.

(56) References Cited

U.S. PATENT DOCUMENTS 3,239,112 A * 3/1966 Porcelli ..... 222/541.9
3,393,817 A * 7/1968 Meierhoefer ..... 215/11.5

(Continued)

OTHER PUBLICATIONS

Notification of Transmittal of the International Search Report and the Written Opinion of the International Searching Authority, in PCT/US08/84850, dated Jan. 23, 2009.

(Continued)

*Primary Examiner* — Frederick C Nicolas
*Assistant Examiner* — Bob Zadeh
(74) *Attorney, Agent, or Firm* — McAndrews, Held & Malloy, Ltd.

(57) ABSTRACT

A gable top or other container having a spout fitment is disclosed. The spout includes a base, a chute, a closure, and a tear line. The base is adapted to be joined to a wall of a container, and defines an opening. The chute communicates with the opening. The chute has a first end at least partially surrounding the opening and a second end spaced from the first end. The closure is positioned to close the chute. The tear line defines a seal of the closure. The tear line is adapted to be broken readily, without relative rotation between the closure and the chute of the spout about an axis generally perpendicular to the base, to open the spout. The base, spout, closure, and tear line can be injection molded as one integrally formed piece.

20 Claims, 15 Drawing Sheets

(56) References Cited

U.S. PATENT DOCUMENTS

| | | | | | |
|---|---|---|---|---|---|
| 3,519,157 | A | * | 7/1970 | Meierhoefer | 215/11.6 |
| 3,544,020 | A | * | 12/1970 | Shaw et al. | 215/12.1 |
| 4,320,861 | A | * | 3/1982 | Rieke et al. | 222/541.9 |
| 4,640,424 | A | * | 2/1987 | White | 215/11.1 |
| 4,706,827 | A | * | 11/1987 | Cabernoch et al. | 215/11.3 |
| 4,848,601 | A | * | 7/1989 | Reil | 222/528 |
| 4,895,282 | A | * | 1/1990 | Robinson | 222/482 |
| 4,903,865 | A | * | 2/1990 | Janowitz | 222/83.5 |
| 5,199,618 | A | * | 4/1993 | Reil et al. | 222/541.5 |
| 5,711,441 | A | * | 1/1998 | Adams et al. | 215/48 |
| 5,934,496 | A | * | 8/1999 | Mogard et al. | 220/258.3 |
| 6,003,728 | A | * | 12/1999 | Elliott | 222/81 |
| 6,056,142 | A | * | 5/2000 | Elliott | 220/278 |
| 6,129,228 | A | * | 10/2000 | Adams et al. | 215/45 |
| 6,216,905 | B1 | | 4/2001 | Mogard | |
| 6,299,012 | B1 | * | 10/2001 | Redmond | 220/266 |
| 6,454,161 | B1 | * | 9/2002 | Rendina et al. | 229/125.15 |
| 6,464,096 | B2 | * | 10/2002 | Adams et al. | 220/258.2 |
| 6,591,999 | B1 | * | 7/2003 | Molin et al. | 220/258.1 |
| 6,742,678 | B1 | * | 6/2004 | Krystopik, Jr. | 222/481.5 |
| 6,983,843 | B2 | * | 1/2006 | Van Geert et al. | 206/438 |
| 7,152,767 | B2 | * | 12/2006 | Seelhofer | 222/536 |
| 7,789,277 | B2 | * | 9/2010 | Baughman et al. | 222/529 |
| 8,028,860 | B2 | * | 10/2011 | Seelhofer | 222/107 |
| 8,302,804 | B2 | * | 11/2012 | Seddon | 220/714 |
| 2002/0104816 | A1 | * | 8/2002 | Feldman et al. | 215/11.1 |
| 2005/0045647 | A1 | * | 3/2005 | Hession et al. | 220/714 |

OTHER PUBLICATIONS

Notification Concerning Transmittal of International Preliminary Report on Patentability, in PCT/US08/84850, dated Jun. 10, 2010.

* cited by examiner

CYLINDRICAL SPOUT FOR DISPOSABLE CARTONS

RELATED APPLICATION

This application is a 371 National Phase filing of International Patent Application Serial No. PCT/US2008/084850 filed Nov. 26, 2008, which claims priority to U.S. Patent Application Ser. No. 60/990,800 filed Nov. 28, 2007, U.S. Patent Application Ser. No. 60/990,825 filed Nov. 28, 2007, and U.S. patent Application Ser. No. 61/017,224 filed Dec. 28, 2007. The above applications are incorporated herein by reference in their entirety.

BACKGROUND OF THE INVENTION

Rectangular shaped cartons are commonly used to package juices and milk products. The cartons typically have a gable-shaped top portion where the liquid is accessed. In one embodiment, a spout is formed by folding back a portion of the paper gable top and peeling open the folded back portion of the gable top. In large, multiuse cartons, a reusable spout fitment may be assembled into the gable top. The spout fitment can have a screw-top closure for sealing the carton after use.

Paper based cartons are widely used for single serve packages of milk and juices. These cartons hold from 8-16 oz (about 240 to 480 cc.) of (typically) liquid contents. The most common size for a single serve carton (used in school cafeterias for milk products) is 8 oz. (about 240 cc.). The liquid is accessed by opening the gable top carton by either: (1) drinking directly from the spout formed by peeling open the gable top or (2) inserting a straw into the opening in the gable top spout.

SUMMARY

One aspect of the disclosed subject matter is a spout for a container. The spout includes a base, a chute, a closure, and a tear line.

The base is adapted to be joined to a wall of a container, and defines an opening. The chute communicates with the opening. The chute has a first end at least partially surrounding the opening and a second end spaced from the first end. The closure is positioned to close the chute.

The base is adapted to be joined to a wall of a container, and defines an opening. The chute communicates with the opening. The chute has a first end at least partially surrounding the opening and a second end spaced from the first end. The closure is positioned to close the chute.

The tear line defines a seal of the closure. The tear line is adapted to be broken readily, without relative rotation between the closure and the chute of the spout about an axis generally perpendicular to the base, to open the spout. The base, spout, closure, and tear line can be injection molded as one integrally formed piece.

BRIEF DESCRIPTION OF SEVERAL VIEWS OF THE DRAWINGS

The following reference characters are used in the drawing figures. Like numbers in the respective figures indicate like or comparable parts.

Figure 1:
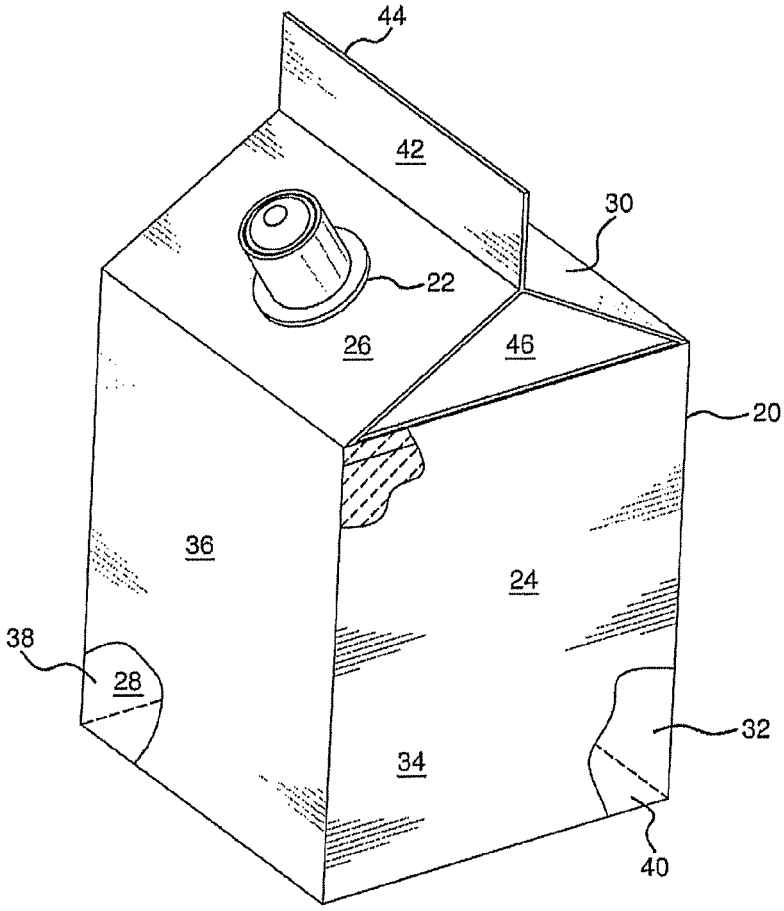
FIG. 1 is a perspective view of a spout incorporated in a gable-top container.

| | |
|---|---|
| 20 | Gable-top carton |
| 22 | Spout |
| 24 | Exterior surface (of 20) |
| 26 | Top panel |
| 28 | Interior surface (of 20) |
| 30 | Top panel (of 20) |
| 32 | Side panel (of 20) |
| 34 | Side panel (of 20) |
| 36 | Side panel (of 20) |
| 38 | Side panel (of 20) |
| 40 | Bottom panel (of 20) |
| 42 | Top ridge (of 20) |
| 44 | Top edge (of 42) |
| 46 | Oblique panel (of 20) |
| 48 | Aperture |
| 49 | Cylindrical plane |
| 50 | Base |
| 52 | Chute |
| 54 | Closure |
| 56 | Tear line |
| 58 | Integral hinge |
| 60 | Wall (of 52) |
| 62 | Central opening (of 50) |
| 66 | Higher edge (of 52) |
| 68 | Second end (of 52) |
| 80 | Spout (FIGS. 4-5) |
| 82 | Pull tab (of 80) |
| 90 | Spout (FIGS. 6-7) |
| 92 | Sealing cover or closure (of 90) |
| 100 | Spout (FIGS. 8-9) |
| 102 | Flap (FIGS. 8-9) |
| 104 | Sealing cover (FIGS. 8-9) |
| 110 | Spout (FIG. 10) |
| 112 | Flattened portion (of 110) |
| 114 | Flattened portion (of 110) |
| 120 | Spout (FIG. 11) |
| 122 | Fold line (of 120) |
| 124 | Fold line (of 120) |
| 130 | Spout (FIGS. 12-13) |
| 132 | Tear line (of 130) |
| 134 | Tear line (of 130) |
| 136 | Tear line (of 130) |
| 138 | Tear line (of 130) |
| 140 | Petal (of 130) |
| 142 | Petal (of 130) |

-continued

| | |
|---|---|
| 144 | Petal (of 130) |
| 146 | Petal (of 130) |
| 148 | Tool (of 130) |
| 150 | Projection (of 130) |
| 152 | Web (of 152) |
| 154 | Web (of 152) |
| 156 | Web (of 152) |
| 158 | Web (of 152) |
| 160 | Projecting surface (of 150) |
| 162 | Body (of 148) |
| 164 | Lip (of 148) |
| 166 | Rim (of 60) |
| 168 | Tether |

DETAILED DESCRIPTION OF THE INVENTION

The following detailed description is only illustrative of the many embodiments of the invention within the scope of one or more of the claims. The inventors do not intend to limit the scope of the claims by reference to specific embodiments, unless done expressly.

The subject of this disclosure is a plastic spout that can be integrated into a carton at the point of manufacturing. The spout can be used as a drinking port for single serve cartons. The plastic spout facilitates ease of use of the single serve carton and is cost effective to produce.

Certain embodiments can be a spout for a single serve carton that dispenses liquid products. The spout can be primarily intended for single use, and when so used does not need to be resealable. The spout can be made simple to use. The spout can be made tamper evident, so the user will readily notice whether the integrity of the contents can be assured at the time of use. The spout can be made to comfortably fit into the mouth of a child who is 5 years old. The spout can be provided at low cost, and can be manufactured in high volume, substantially defect free. The spout optionally can provide venting into the carton to facilitate drinking.

The spout can have a one-part construction well suited to an injection molding process. The spout can be composed of a thermoplastic—in one embodiment polyethylene can be used. Other suitable materials include, but are limited to co-polymers containing polyethylene, PET and PVC. The ideal materials (1) cost little, (2) can be readily molded in thin walled sections, (3) are not prone to stretch or string extensively. The spout material should readily tear when a force is applied.

Figure 3A:
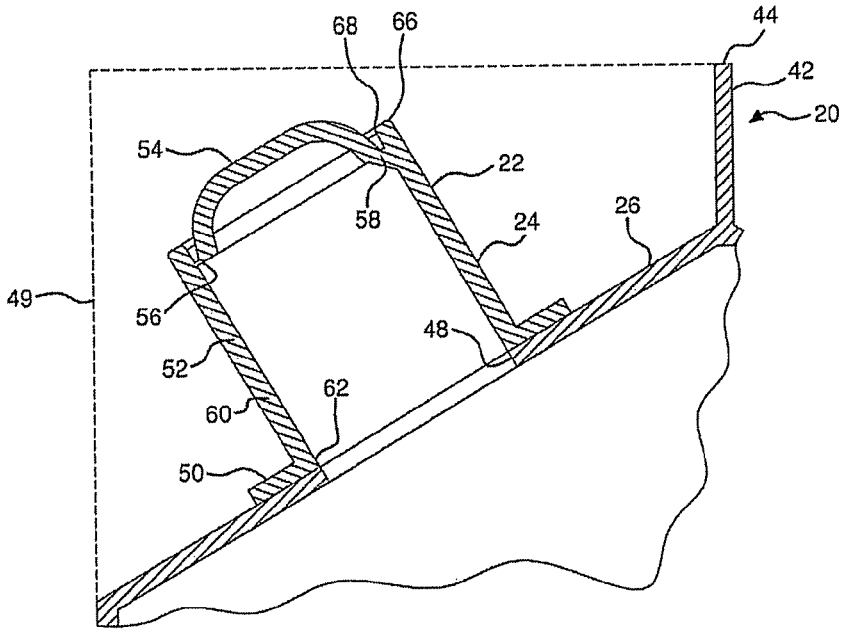
FIG. 3A is a fragmentary section taken along section lines 3-3 of FIG. 1.

Referring now to the figures, FIG. 1 shows one contemplated environment for use of the spout—a gable-top carton or other container or vessel 20. The vessel 20 has a spout 22 attached to its exterior surface 24, in this instance on the oblique top panel 26. In another embodiment, the spout 22 can be attached to the interior surface 28 of the carton. The carton 20 of this embodiment also has an oblique top panel 30, generally vertical side panels 32, 34, 36, and 38, a bottom panel 40, a top ridge 42 having a top edge 44, and oblique panels such as 46. In this embodiment, the top edge 44 is the highest part of the container when the container is upright. (In this disclosure, "top and "bottom," "vertical" and horizontal", "highest," or the like, refer to the container when in its usual upright position, as in FIG. 1.) The generally vertical side walls 32, 34, 36, and 38 define a rectangular cylinder 49 (FIG. 3A). A container such as the carton 20 illustrated in FIG. 1 is commonly made by providing a single sheet of cut and scored container stock, such as polyethylene-coated board, folding it, and assembling the side seam, bottom, and top to form the complete container.

The disclosed spouts are not limited to use on gable-top containers such as 20. The spouts can be used in conjunction with a container of any type having at least one wall. For example, the container could be a blow-molded jug, a glass bottle, a can, a pouch, a pouch contained in a box, a drum, or any other configuration. The container could also be a folded container in which the top panels 26 and 30 are folded flat and the spout 22 is incorporated in the flat top wall. Embodiments are also contemplated in which the spout 22 is incorporated in a screw top cap or a stopper for a conventional bottle or jug. Additional embodiments are contemplated in which the spout 22 is mounted in a side wall such as 34, at any point on the wall, although locations near the top or near the bottom of the side wall are specifically contemplated. Additional embodiments are contemplated in which the spout 22 is mounted in an oblique panel such as 42. In the latter embodiment, the container score lines and cuts optionally can be rearranged to recess one or both ends of the top ridge 42, opening up access to a spout such as 22 mounted on the oblique panel 46.

Figure 3B:
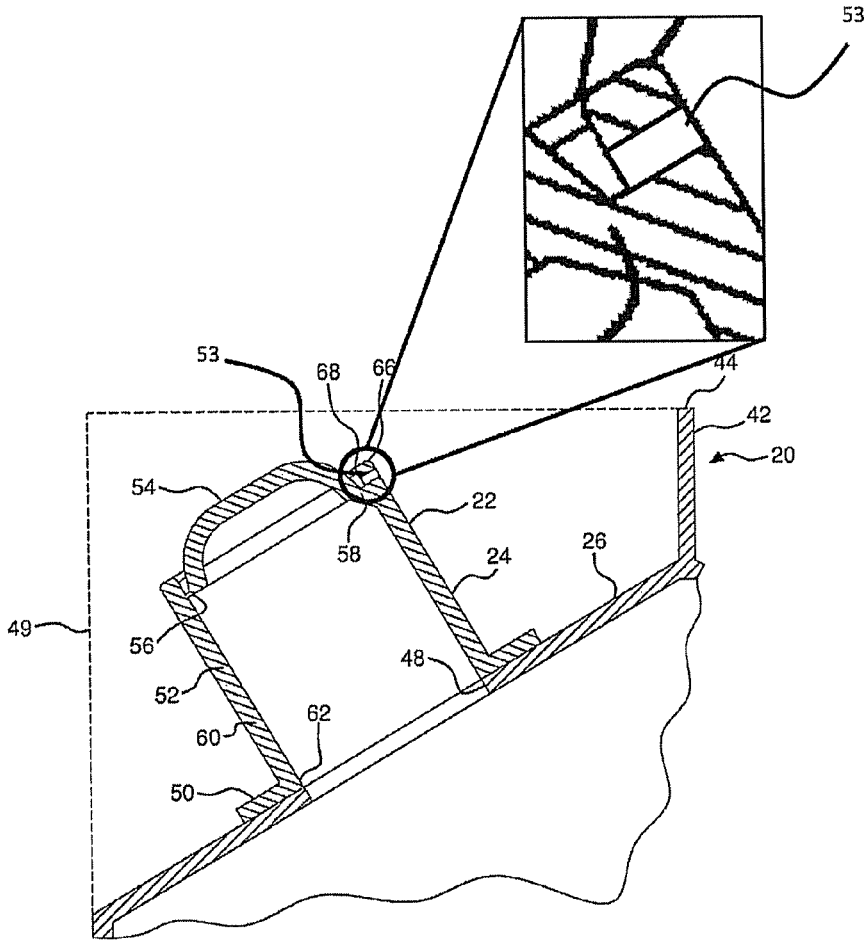
FIG. 3B illustrates the chute of FIG. 3A but with an open cross section.

Referring briefly to FIGS. 3A and 3B, the container 20 also has an aperture 48 formed in the wall 26. The spout 22 is secured to the wall 26 to close and seal the aperture 48 until the spout is opened. FIGS. 3A and 3B also illustrates that the spout 22 can be mounted within the cylindrical plane 49 defined by the generally vertical faces of the side panels 32, 34, 36, and 38, and beneath the level of the top edge 44 of the top ridge 22. Alternatively, the spout 22 could extend beyond the confines of the cylindrical plane 49, above the top edge 44, or both.

Figure 2:
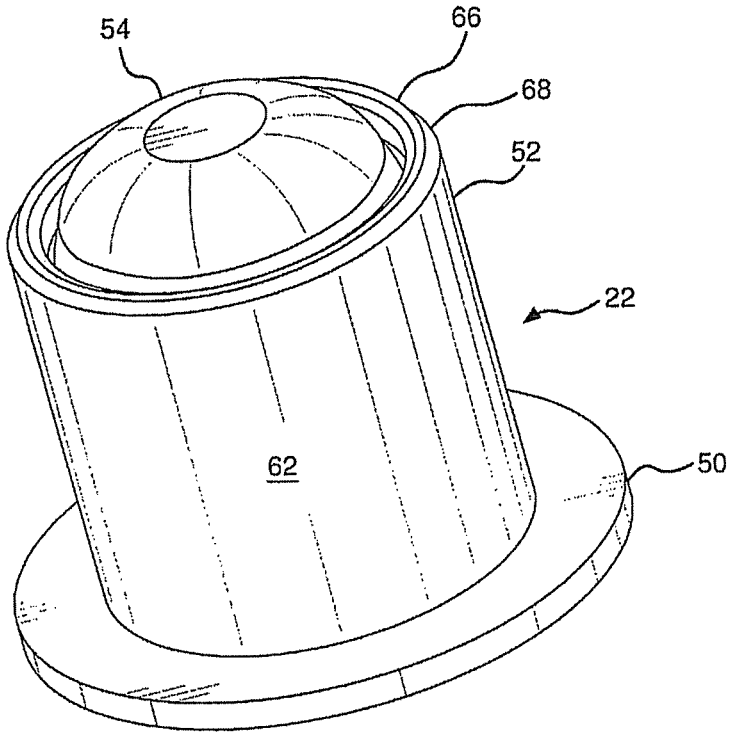
FIG. 2 is an enlarged, isolated perspective view of the spout shown in FIG. 1.

Referring now particularly to FIGS. 2, 3A, and 3B, the spout 22 of this embodiment includes a base 50, a chute 52, a closure 54, and a tear line 56. The spout 22 is injection molded as one integrally formed piece. In the illustrated embodiment, the second end 68 of the chute 52 projects outward from the base 50. The tear line 56 is adapted to be broken readily, without relative rotation between the closure 54 and the chute 52 of the spout 22 about an axis generally perpendicular to the base 50, or in the plane of the base 50, to open the spout 22.

Figure 3C:
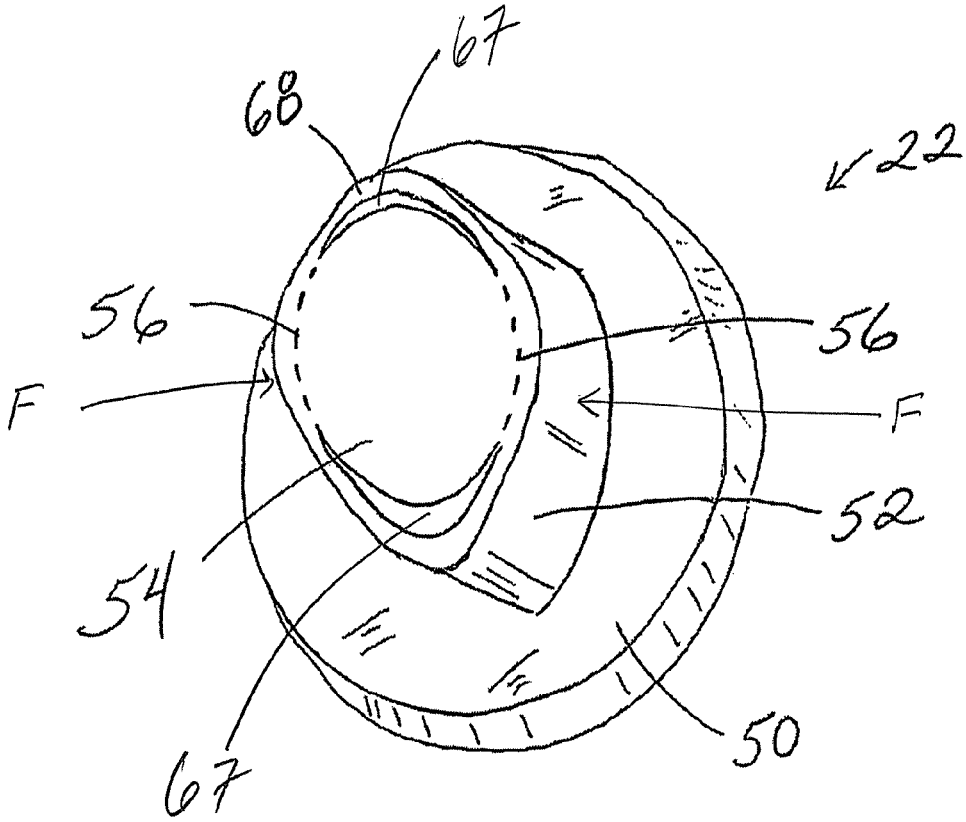
FIG. 3C is an exemplary illustration of a tear line being broken as a force is being applied to the chute according to certain embodiments.

For example, FIG. 3C provides, for illustration purposes, one example of a tear line 56 being broken without the tear line 56 being broken in a sequential, rotational direction about the tear line 56 about an axis perpendicular to the base 50 as a force (F) is being applied to the chute 52. In this example, the entire tear line 56 has not been, at least yet, entirely broken. As shown, the force (F) being applied to the chute 52 deforms at least the second end 68 of the chute 52 from its nominal shape to a flatter shape. As such deformation of the second end 68 of the chute 52 may not equally deform the closure 54, breaks 67 may develop along at a least portion of the tear line 56. The location, number, and/or order in which breaks 67 may develop and/or expand in the tear line 56 may depend on a number of variables.

A portion of the boundary between the closure 54 and at least one of the base 50 and the chute 52 can define an integral hinge 58, in this embodiment. The integral hinge 58 is defined in this embodiment by a portion of the boundary between the closure 54 and the chute 52. For example, if the boundary between the closure 54 and the chute 52 is circular, most of the boundary, such as 320 or 340 degrees, is breakable upon opening, and the remaining 40 or 20 degrees around the circle is an integral hinge 58. The integral hinge 58 can alternatively have essentially the same construction as the tear line 56, and the tear line 56 can be left unbroken on part of its length when the remainder is broken to open the container 20. Alternatively, the integral hinge 58 can be more easily broken than the chute 52 but not as easily broken as the tear line 56. Thus, the spout 22 can be versatile, allowing the closure 54 to be either tethered by an unbroken part of the tear line 56/integral hinge 58 or completely removed, at the option of the user.

In an alternative embodiment, a portion of the boundary between the closure 54 and the base 50 can define the integral hinge 58. In such an embodiment, the tear line 56 and the integral hinge 58 could be at the intersection of the base 50 and the chute 52, for example. The integral hinge 58 can be inelastically deformable when the spout 22 is opened, thereby causing the closure 54 to normally remain displaced from the chute 52 after the spout is opened.

The spout 22 of an alternative embodiment could include a vent, for example taking the form of an open tube integral with and running parallel to the inside of the wall 60 of the chute 52, to allow air to be introduced into and through the central opening 62 of the base 50, and thus through the aperture 48, after the spout 22 is opened.

The base 50 is generally annular in this embodiment, although the opening 62 could be eccentric, oval in cross-section, or have other configurations. The base 50 is adapted to be joined to a wall of a container. As illustrated in FIGS. 3A and 3B, the base 50 is joined, as by adhesive or ultrasonic welding, to the exterior surface 24 of the container 20. In an alternative embodiment, the chute 52 could project through the aperture 48 with the base 50 within the container and joined to the interior surface 28 of the container 20. The chute 52 communicates with the opening 62 defined by the base 50, and also with the aperture 48 through the exterior surface 24.

The chute 52 has a first end at least partially surrounding the opening 62 and a second end 68 spaced from the first end. The chute 52 of FIG. 3A has a closed or generally cylindrical or tubular cross-section, but it could alternatively have an open cross section providing an opening 53 along part or all of the higher edge 66 (the right side as shown in FIG. 3B) of the chute 52, particularly an opening defined by an extension of the tear line 56 down the higher edge 66, providing a seal of the open portion of the cross-section until the container is opened. This open portion of the chute 52 can define a vent for allowing air to enter the container 20 while the contents of the container 20, particularly if liquid, are dispensed through the chute 52.

The closure 54 is located at and closes at least the second end 68 of the chute 52, and is dome-shaped, in this embodiment. As shown in FIG. 3A, "located at" does not require the closure 54 to be at the outboard extremity of the second end 68.

The tear line 56 defines a boundary and seal between the closure 54 and the base 50, the chute 52, or both. In the embodiment of FIG. 3A, the tear line 56 defines a boundary and seal between the closure 54 and the chute 52. In an alternative embodiment the closure 54 could have a skirt extending over the chute 52 to the base 50, and the tear line 56 could define a boundary and seal between the closure 54 and the base 50. This construction, however, might be more difficult or expensive to manufacture than the illustrated embodiments.

In another alternative embodiment, the entire boundary between the closure 54 and either the base 50, the chute 52, or both, is one or more tear lines such as 56, allowing the closure 54 to be separated and completely removed from the spout 22. This embodiment would have the advantage of allowing the closure 54 of the opened container to be completely removed and discarded before the contents of the container 20 were dispensed. The closure 54 of this embodiment would be difficult to replace to give the container the appearance of being unopened, providing a visual indication that the container in fact has been opened or tampered with. The closure 54 also would not have any potential to interfere with consumption of the contents of the container 20.

The tear line 56 is adapted to be broken readily, to open the container, without relative rotation between portions of the spout in the plane of the tear line 56. Breaking the tear line 56 allows the closure 54 to be displaced relative to the spout to open the spout.

In certain embodiments, the tear line 56 is adapted to be broken at least in part by deforming the chute 52. This can be done, for example, by making the material of the tear line 56 thin or otherwise easily breakable, and/or the closure 54 stiff, and/or the chute 52 easily deformed at the second end 68 from its nominal shape to a flatter shape. If these variables are controlled to meet this objective, deformation of the second end 68 of the chute 52 to a flatter shape (as by pinching the chute 52 with one's fingers) does not equally deform or flatten the closure 54. This difference in the respective shapes of the closure 54 and the second end 68 at the tear line 56, caused by pinching the chute 52, strains and thus breaks the tear line 56, opening the spout 22.

The spout 22 can also be made so that breaking the tear line 56 to open the spout generates a sound, providing audible feedback that the tear line 56 was intact until the spout 22 was opened. This sound can be distinctive from the sound made when the spout 22 is reopened after being opened and closed.

The spout 22 can be composed of a circular-shaped ring at the base 50 of the spout, responsible for sealing to the carton. A generally cylindrical-shaped tube can extend upward from the ring to form the spout 22. A sealing cover can be positioned on the open end of the spout 22. The sealing cover can be integrally molded into the spout 22. The sealing cover can be attached to the upper portion of the spout 22 by a thin-walled region. The thickness of the thin-walled section can be 0.05-0.2 mm, more preferably 0.08-0.15 mm.

Referring again to FIGS. 2 and 3, the sealing cover (prior to opening) can provide a liquid-tight seal and tamper evidence. To open the spout 22, the spout 22 can be squeezed (pinched together). As the spout 22 is squeezed, the thin-walled area of the sealing cover that attaches the sealing cover to the spout 22 (either completely or partial) can be broken. In one embodiment, the sealing cover may be completely removed. In another embodiment, the seal cover can be partially removed to form a flip-top closure 54.

Once the sealing cover has been removed, the user directs the spout 22 to his or her mouth and inverts the carton to release the flow of liquid through the spout 22. The inside diameter of the spout 22 can be 8-15 mm, more preferably 9-12 mm and still more preferably 10 mm. The wall thickness of the spout 22 can be 0.4-0.8 mm, more preferably 0.5-0.7 mm.

Figure 4:
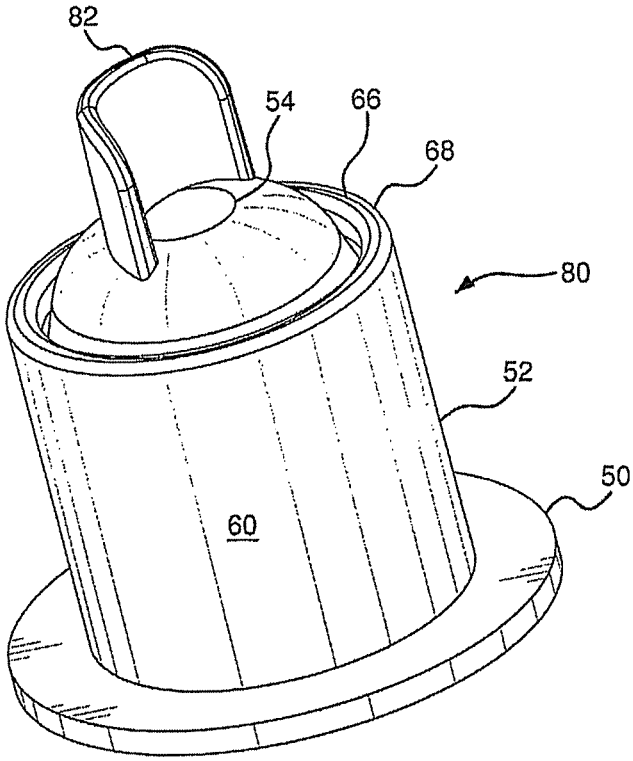
FIG. 4 is a view similar to FIG. 2 of an alternative embodiment of the spout.
Figure 5:
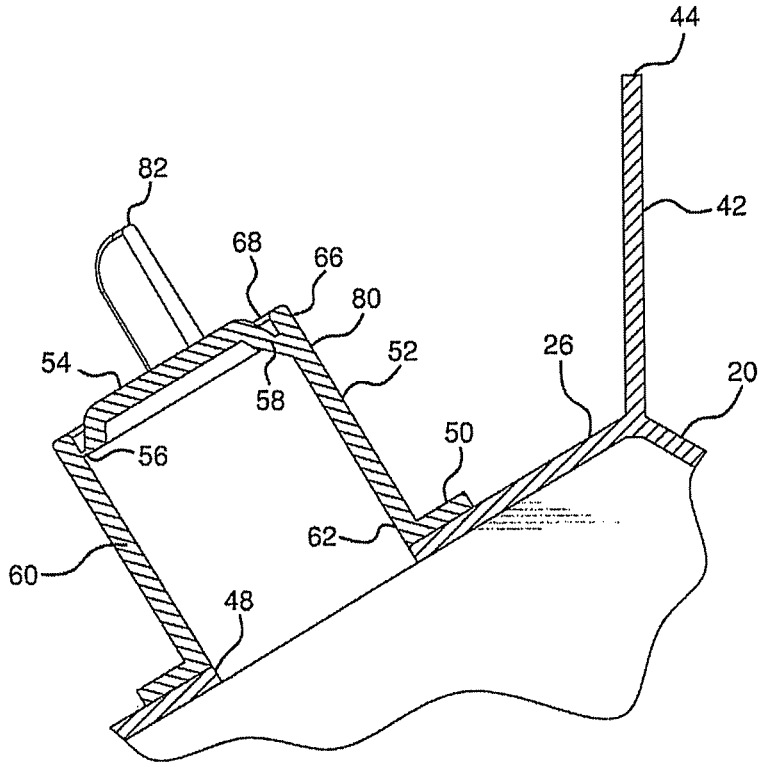
FIG. 5 is a view similar to FIG. 3A of the alternative embodiment of FIG. 4.

FIGS. 4 and 5 show an alternative embodiment of a spout 80 with a removable pull tab 82 secured to the closure or sealing cover 54. In this embodiment, the overall height of the spout 80 (including the pull tab 82) does not extend beyond the height of the gable top of the carton. The sealing closure or cover 54 (prior to opening) provides a liquid-tight seal and a means of tamper evidence. To open the spout 80, the user squeezes the chute 52 together, pulls the tab 82 upward, or does both at once. Either action, or both together, can cause the thin-walled area of the sealing cover that attaches the sealing cover to the spout 80 (either completely or partial) to be broken. The thickness of the thin-walled section can be 0.05-0.2 mm, more preferably 0.08-0.15 mm. In one embodiment, the pull tab 82 and closure 54 may be completely removed. In another embodiment, the pull tab can be partially removed in such a way as to form a flip-top closure 54 with an integral hinge 58.

Figure 6:
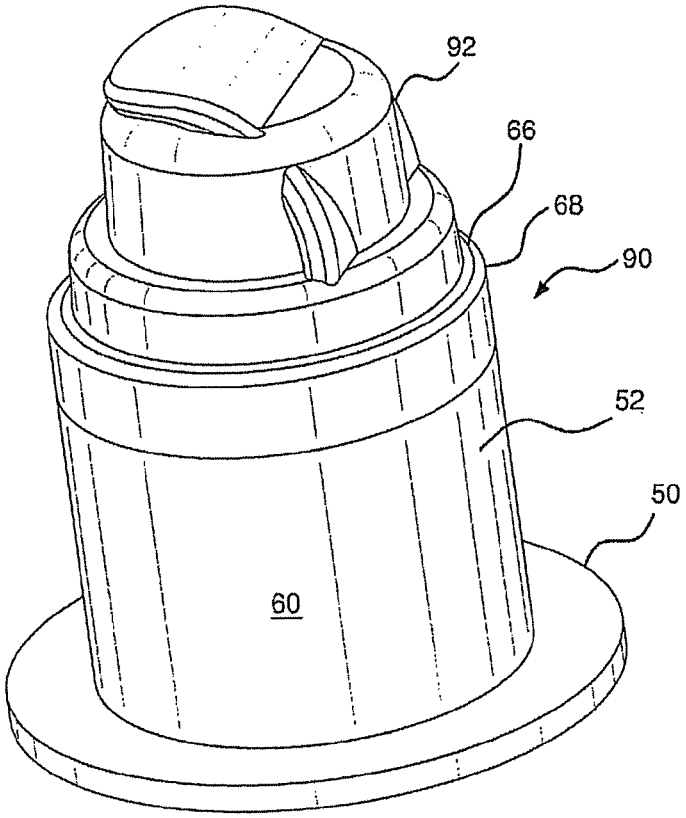
FIG. 6 is a view similar to FIG. 2 of an alternative embodiment of the spout.
Figure 7:
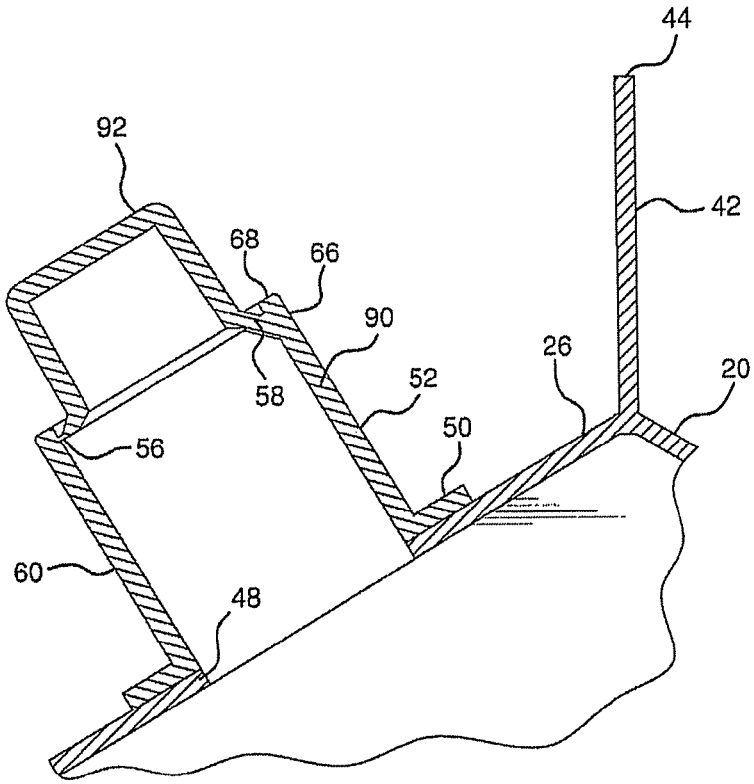
FIG. 7 is a view similar to FIG. 3 of the alternative embodiment of FIG. 6.

The embodiment of FIGS. 6 and 7 is a spout 90 with a more nearly cylindrical outwardly protruding sealing cover or closure 92. The sealing cover 92 can be attached to the main spout via a thin-walled section defining a tear line, as in the embodiments of FIGS. 1-5. The thickness of the thin-walled section can be 0.05-0.2 mm, more preferably 0.08-0.15 mm.

To open the spout, the user can squeeze the chute 52 together and pull the sealing cover 92 upward. In this embodiment, the sealing cover 92 is more easily grasped than the closure 54 of FIG. 3. As the tube is squeezed together and/or the cover 92 is pulled upward, the thin-walled area or tear line 56 of the dome-shaped sealing cover 92 can be either completely or partial broken. The user then can swing the dome-shaped sealing cover open by flexing the integral hinge 58 to expose the spout orifice or second end 58. In one embodiment, as illustrated, the dome-shaped sealing cover 92 can be partially removed in such a way as to form a flip-top closure. Alternatively, as described before, the dome-shaped sealing cover 92 can be completely removed to open the spout 90.

Figure 8:
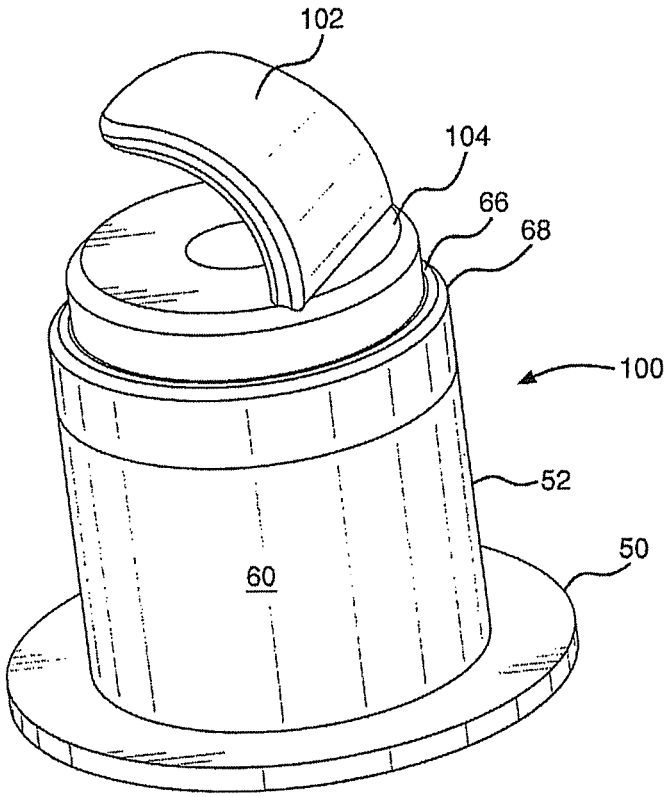
FIG. 8 is a view similar to FIG. 2 of an alternative embodiment of the spout.
Figure 9:
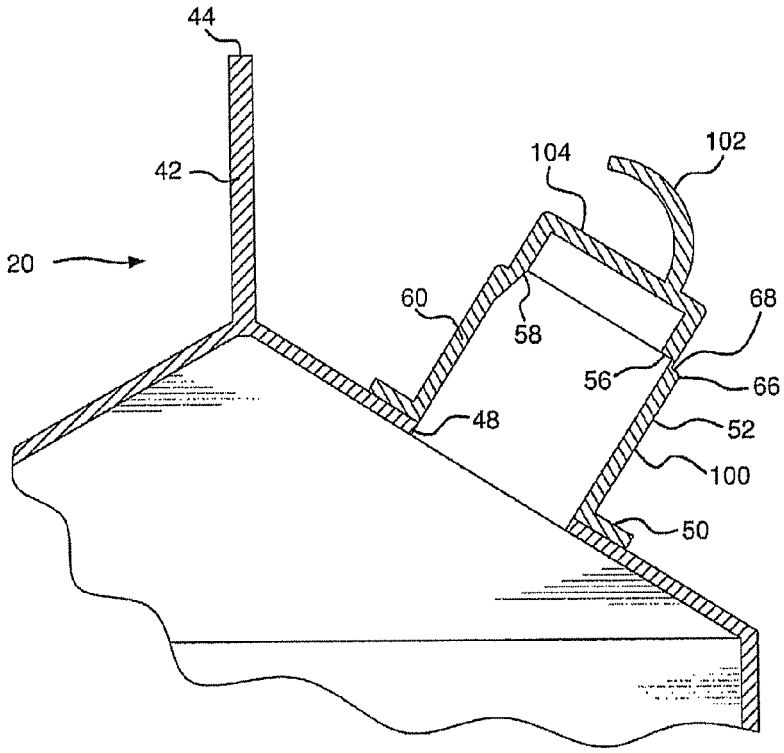
FIG. 9 is a view similar to FIG. 3A of the alternative embodiment of FIG. 8.

The spout 100 of FIGS. 8 and 9 incorporates a full flap 102 on a dome-shaped sealing cover 104. It can be opened as described for FIGS. 4 and 5. One potential advantage of the spout 100 is that, when the spout 100 is opened, the user can capture the flap 102 against the container, using a finger or thumb of the hand used to hold the container while dispensing its contents. This allows the user to easily hold the sealing cover 104 out of the way while drinking or pouring from the container. This can also be done with the closures 54 and 92, shown in other embodiments.

Figure 10:
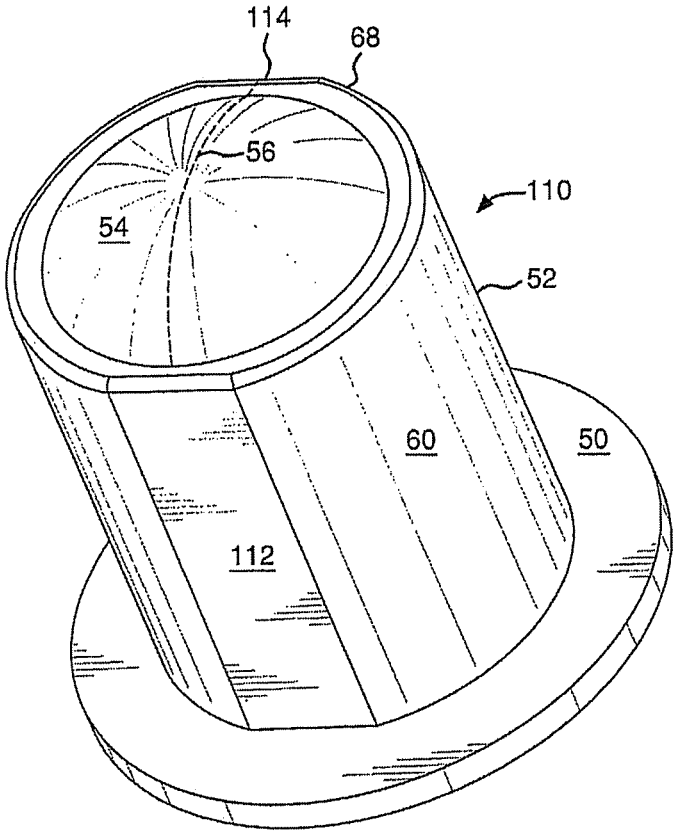
FIG. 10 is a view similar to FIG. 2 of another embodiment of the invention.

FIG. 10 shows another embodiment, 110, of a spout in which the side wall 60 has one or more (here, two) flattened portions such as 112 and 114 defining first and second grip areas disposed on opposite sides of the chute. The tear line 56 bridges across the closure 54 between the flattened portions 112 and 114, in this embodiment. The grip areas 112 and 114 also provide an orientation feature to allow correct orientation of the spout 110 during assembly with a container. The grip areas 112 and 114 can be selected to provide convenient, well-located places to grasp the spout 110 when deforming its side wall 60, such as by pinching or biting the side wall 60 at the flattened portions 112 and 114, thus parting the tear line 56 to open the spout 110. With the arrangement of the tear line 56 bridging between the flattened portions 112 and 114, squeezing the flattened portions 112 and 114 will open up the cavity exposed by tearing the closure 54 along the tear line 56, in a duck bill arrangement.

Figure 11:
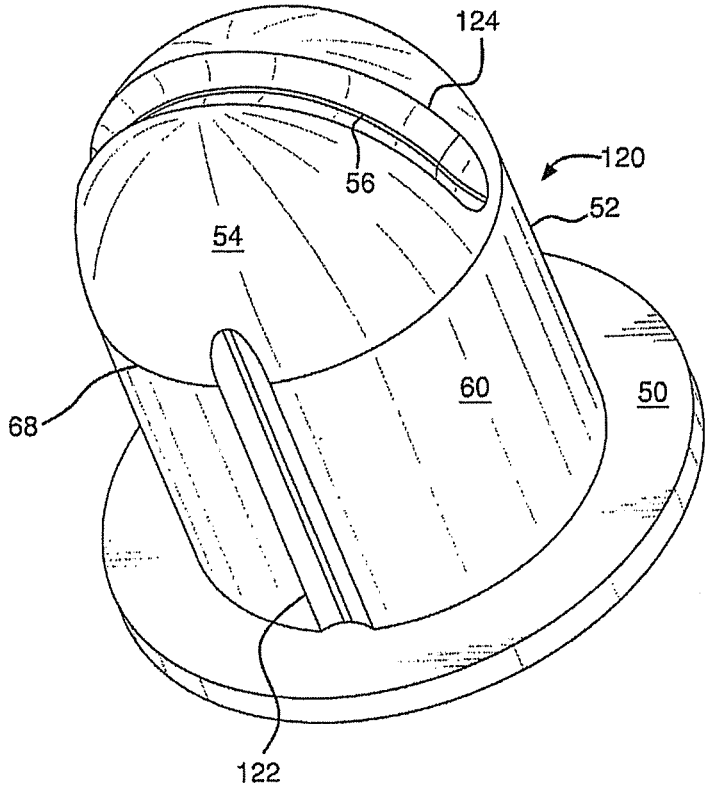
FIG. 11 is a view similar to FIG. 2 of still another embodiment of the invention.

FIG. 11 shows another embodiment 120 of the spout in which at least one fold line 122, and optionally one or more other fold lines as well, are provided in the wall 60. For example, a diametrically opposed, parallel fold line (not shown) can be formed in the side of the spout 120 not visible in FIG. 11.

The fold lines such as 122 can define areas of flexibility in the spout 120, since the illustrated fold lines such as 122 have reduced radial material thickness, compared to nearby portions of the wall 60.

The illustrated fold lines extend into the closure 54. The fold lines such as 122 in the chute 52 also serve as areas to grasp when deforming the chute 52 inward to break the tear line 56, which in this embodiment extends across the closure 54, generally orthogonal to the fold lines such as 122.

The closure 54 of FIG. 11 also has a trough 124 in which the tear line 56 runs. The trough 124 is more easily seen than the tear line 56, to provide a visual indication in the unopened spout 120 of the location of the tear line 56. The trough 124, the fold lines such as 122, or a combination of these portions also provide an orientation feature to allow correct orientation of the spout 120 during assembly with a container.

The embodiments of FIG. 10 can be opened in various ways. To drink from the spout the user can bite the spout 110 of FIG. 10 at the flattened portions 112, or the spout 120 of FIG. 11 at the fold lines 122. When the spout is inverted in the squeezed orientation, liquid is permitted to flow through the spout. When the user releases the spout, the cavity exposed by parting of the tear line 56 will at least partially close, limiting spillage. Alternatively, the spout can be squeezed in some other manner, as with the fingers, to part the tear line 56.

Additionally, once the tear line 56 is parted initially to open the container, the parted tear line can be opened up more easily a second time, using less force. For example, it might be initially opened by biting the spout, then opened a second time by squeezing the spout with the fingers. This differential between the necessary initial opening force and the necessary reopening force can be used to assure that the spout 110 or 120 will not open prematurely due to handling (as by carrying the container by its unopened spout), but will easily be reopened using minimal force, as to insert a straw through the parted tear line.

Figure 12:
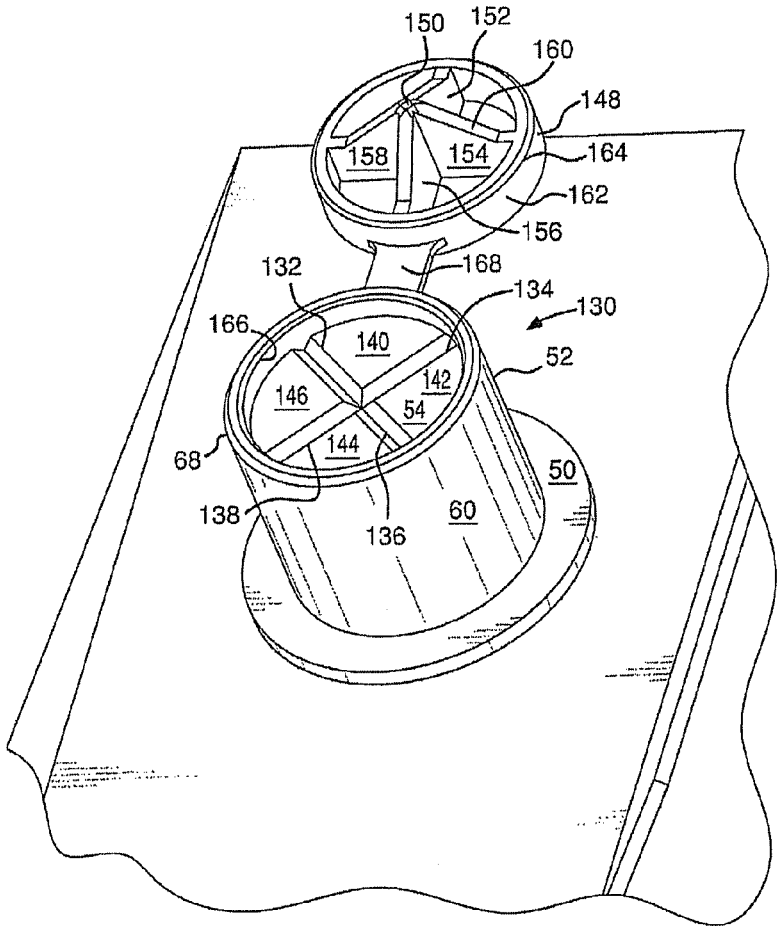
FIG. 12 is a view similar to FIG. 2 of even another embodiment of the invention, before use.
Figure 13:
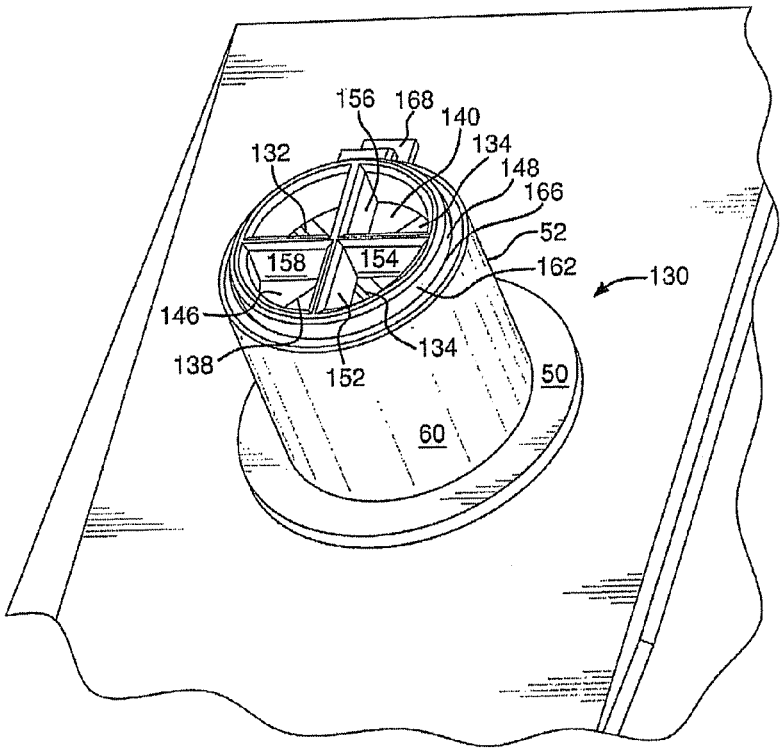
FIG. 13 is a view of the embodiment of FIG. 12, after the opening tool is applied to open the closure.

FIGS. 12 and 13 show another embodiment, 130, of the invention. In this embodiment, at least a portion of the tear line is generally X-shaped. Specifically, the X-shaped tear line 132-138 of FIG. 12 is made up of four segments, respectively 132, 134, 135, and 138, which subdivide the closure into four petals 140, 142, 144, and 146.

Any two segments of the X-shaped tear line 132-138 divide the closure 54 into two parts. For example, the tear lines 132 and 136 subdivide the closure the closure 54 into two about half-circular or 180-degree parts. The tear lines 134 and 138 also subdivide the closure 54 in the same way. For another example, the tear lines 132 and 134 subdivide the closure 54 into two parts, one an about quarter-circular or 90-degree part 140, and the other an about %-circular or 270-degree part. In the same way, any three segments of the X-shaped tear line 132-138 divide the closure 54 into three parts, and all four segments of the X-shaped tear line 132-138 divide the closure 54 into four parts.

In the embodiment of FIGS. 12 and 13, a tool 148 is integrally formed with the spout 130 for breaking the tear line 132-138. The tool 148 comprises a projection generally indicated at 150. The projection 150 of this embodiment is a composite of four generally triangular webs 152-158. The projection 150 is adapted for puncturing the generally X-shaped tear line 132-138, breaking the closure 54 of this embodiment into four petals 140-146.

The projection 150 is also adapted for displacing at least a portion of the closure relative to the chute, as by folding or deforming the petals 140-146 axially inward. In the illustrated embodiment, the webs 152-158 are displaced or out of phase by 45 degrees, relative to the segments 132-138 defining the generally X-shaped tear line. Thus, each projecting surface such as 160 of the projection 150 bears against one of the petals such as 142 subdivided from the closure 54. This bearing force folds or breaks away the petals such as 142 axially inward.

In an embodiment, at least part of the outer circumference of each petal such as 142 defines an integral hinge, allowing the petal such as 142 to fold inward and remain attached to the spout 130. In this embodiment, part of the outer circumference may also be part of the tear line. In an alternative embodiment, the entire outer circumference of each petal such as 142 is also part of the tear line, allowing one to readily break the petals 142 completely free of the spout 130. These two embodiments can be present in a single spout 130, as if one or more of the petals 140-146 is adapted to fold inward, and the remaining petals are adapted to break away. Such an arrangement may be desired, for example, to regulate the ease of flow of contents through the chute 52 after the spout 130 is opened.

In the illustrated embodiment, comparing FIGS. 12 and 13, the tool 148 has a body 162 having a lip 164 of smaller diameter than the rim 166 of the wall 60 of the chute 52. Thus, when the tool is deployed as shown in FIG. 13, the lip 164 fits within the rim 166, and optionally can be wedged or otherwise secured in the position shown in FIG. 13. In this position, the body 162 forms an extension of the chute 52, through which the contents of the open container can be poured or consumed with the petals 140-146, if still attached, positively held out of the way.

When the tool is deployed as shown in FIG. 13, its webs 152-158 act as a strainer to prevent relatively large objects, or perhaps a finger, from being inserted into or removed through the chute 52. For example, if breakaway petals are used, the spaces between the webs 152-158 can be too small to pass one of the petals, preventing the consumer from ingesting them.

Alternatively, the tool could be deployed as shown in FIG. 13 for opening a closure similar to that of the earlier-described embodiments, having a boundary defined by a circular tear line. Applying the tool would then break the tear line and force the closure into the container.

The space between two adjacent webs of the tool deployed as shown in FIG. 13 can also be selected to allow a drinking straw to be inserted into the container to consume the contents. If two or more straws are inserted at the same time, the partition of the chute 52 by the webs 152-158 into plural spaces can allow the respective straws to be easily distinguished by which space each is inserted into. Drinking or pouring holes can also be partitioned from vent holes.

The tool 148 of this embodiment is joined to the remainder of the spout by an integral hinge or tether 168. In an alternative embodiment, the tool 148 could be a separate part used by an authorized person, such as a supervisor at a school, to open containers when the contents are served. Just like a food can or a crown capped bottle that is not easy to open without an opening tool, a spouted container requiring a tool to open it can be advantageous in limiting who can open it and when it can be opened. In another alternative embodiment, the hinge 168 can instead be a breakaway tether, keeping the tool 148 available for use but not functioning as a hinge. In an embodiment, the tool 148 can be permanently latched or lodged in place when used to open the container, so the fact that it is opened can be readily ascertained.

What is claimed is:

1. A spout for a container, comprising:

A. a base adapted to be joined to a wall of a container, the base defining an opening;

B. a chute communicating with the opening, the chute having a first end at least partially surrounding the opening and a second end spaced from the first end;

C. a closure positioned to close the chute; and

D. a tear line defining a seal of the closure, the tear line being adapted to be broken readily at least in part by deforming the chute and without relative rotation between the closure and the chute of the spout about an axis perpendicular to the base, to open the spout;

E. wherein the base, spout, closure, and tear line are injection molded as one integrally formed piece.

2. The spout of claim 1, further comprising a pull tab secured to the closure.

3. The spout of claim 1, wherein the base has an annular shape.

4. The spout of claim 1, wherein the closure is located at and closes the second end of the chute.

5. The spout of claim 1, wherein the second end of the chute projects outward from the base.

6. The spout of claim 1, wherein breaking the tear line to open the spout generates a sound providing audible feedback that the tear line was intact until the spout was opened.

7. The spout of claim 1, further comprising a vent to allow air to be introduced into the base opening after the spout is opened.

8. The spout of claim 1, wherein the tear line is between 0.05 and 0.2 mm thick, and the wall in which the tear line is formed is 0.4 to 0.8 mm thick.

9. The spout of claim 1, wherein the closure is dome-shaped.

10. The spout of claim 1, further comprising a boundary between the closure and at least one of the base and the chute, wherein a portion of the boundary defines an integral hinge.

11. The spout of claim 10, wherein a portion of the boundary between the closure and the chute defines an integral hinge.

12. The spout of claim 10, wherein a portion of the boundary between the closure and the base defines an integral hinge.

13. The spout of claim 10, wherein the integral hinge is inelastically deformable when the spout is opened, thereby causing the closure to normally remain open after the spout is opened.

14. The spout of claim 1, wherein the tear line provides a boundary between the closure and at least one of the base and the chute, allowing the closure to be removed from the spout.

15. The spout of claim 14, wherein the boundary between the closure and the chute is the tear line.

16. The spout of claim 14, wherein the boundary between the closure and the base is the tear line.

17. The spout of claim 1, wherein the chute has a closed cross-section.

18. The spout of claim 1, wherein the chute has an open cross section.

19. A spout for a container, comprising:

A. a base adapted to be joined to a wall of a container, the base defining an opening;

B. a chute communicating with the opening, the chute having a first end at least partially surrounding the opening and a second end spaced from the first end;

C. a closure positioned to close the chute;

D. a tear line defining a seal of the closure, the tear line being adapted to be broken readily, without relative rotation between the closure and the chute of the spout about an axis perpendicular to the base, to open the spout; and E. first and second fold lines disposed on opposite sides of the chute;

F. wherein the base, spout, closure, and tear line are injection molded as one integrally formed piece.

20. A spout for a container, comprising:

A. a base adapted to be joined to a wall of a container, the base defining an opening;

B. a chute communicating with the opening, the chute having a first end at least partially surrounding the opening and a second end spaced from the first end;

C. a closure positioned to close the chute;

D. a tear line defining a seal of the closure, the tear line being adapted to be broken readily, without the tear line being broken in a sequential, rotational direction about the tear line about an axis perpendicular to the base, to open the spout; and E. a projection configured to puncture the tear line to break the tear line;

F. wherein the base, spout, closure, projection, and tear line are injection molded as one integrally formed piece.

* * * * *

UNITED STATES PATENT AND TRADEMARK OFFICE

CERTIFICATE OF CORRECTION

PATENT NO. : 8,770,450 B2
APPLICATION NO. : 12/993395
DATED : July 8, 2014
INVENTOR(S) : Giraud et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 604 days.

Signed and Sealed this
Tenth Day of May, 2016

Michelle K. Lee

Michelle K. Lee
*Director of the United States Patent and Trademark Office*